United States Patent [19]

Taya et al.

[11] Patent Number: 4,972,083

[45] Date of Patent: Nov. 20, 1990

[54] POST-ACCELERATION DETECTOR FOR MASS SPECTROMETER

[75] Inventors: Shunroku Taya, Mito; Minoru Uchida, Ibaraki; Akiyoshi Yasuda, Katsuta, all of Japan

[73] Assignee: Hitachi, Ltd., Tokyo, Japan

[21] Appl. No.: 460,372

[22] Filed: Jan. 3, 1990

[30] Foreign Application Priority Data

Jan. 9, 1989 [JP] Japan ..... 01-002264

[51] Int. Cl.[5] ..... H01J 49/00

[52] U.S. Cl. ..... 250/281; 250/256; 313/105 R

[58] Field of Search ..... 250/281, 282, 283, 296; 313/105 R, 105 CM, 536

[56] References Cited

U.S. PATENT DOCUMENTS

| | | | |
|---|---|---|---|
| 3,898,456 | 8/1975 | Dietz | 250/283 |
| 3,986,024 | 10/1976 | Radermachec | 250/283 |
| 4,171,482 | 10/1979 | Vastel | 250/296 |
| 4,267,448 | 5/1981 | Feser et al. | 250/281 |
| 4,766,312 | 8/1988 | Fergusson | 250/283 |
| 4,810,882 | 3/1989 | Bateman | 250/281 |
| 4,835,383 | 5/1989 | Mahoney | 250/281 |

FOREIGN PATENT DOCUMENTS

| | | |
|---|---|---|
| 57-107550 | 7/1982 | Japan . |
| 57-115752 | 7/1982 | Japan . |
| 58-38446 | 3/1983 | Japan . |
| 62-40147 | 2/1987 | Japan . |
| 62-40148 | 2/1987 | Japan . |

OTHER PUBLICATIONS

"Mass Spectrometry in Science And Tech." Edited by F. A. White, Published by John Wiley & Sons, Inc. pp. 101–109, 1968.

*Primary Examiner*—Bruce C. Anderson

*Attorney, Agent, or Firm*—Antonelli, Terry, Stout & Kraus

[57] ABSTRACT

A post-acceleration detector for a mass spectrometer comprises a conversion electrode bombarded by an ion beam thereby emitting charged particles having a polarity opposite to that of the ion beam, a charged particle detector amplifying and detecting the charged particles, and a mechanism for moving the conversion electrode relative to the charged particle detector according to the energy of the ion beam.

5 Claims, 5 Drawing Sheets

POST-ACCELERATION DETECTOR FOR MASS SPECTROMETER

BACKGROUND OF THE INVENTION

This invention relates to a post-acceleration detector for a mass spectrometer, and more particularly to a post-acceleration detector of the kind described above which is capable of also detecting low-acceleration ions and high-mass ions.

Known publications disclosing prior art post-acceleration detectors for mass spectrometers include U.S. Pat. No. 4,267,448; a book entitled "Mass Spectrometry in Science and Technology" edited by F. A. White, published by John Wiley & Sons, Inc. pp. 101–109; JP-B2-58-7229; JP-B2-59-16706; JP-A-54-139592; JP-A-57-107550; JP-A-57-115752; JP-A-58-38446; JP-A-61-233958; JP-A-62-40147; JP-A-62-40148; and JP-A-63-276862.

According to the disclosures of these known publications, an ion beam, for example, a positive ion beam is directed to bombard a conversion electrode applied with a negative voltage thereby causing emission of negative charged particles from the bombarded surface of the conversion electrode, and the charged particles are then amplified by a secondary electron multiplier so as to detect an ionic current. Thus, when a considerably high voltage is applied to the conversion electrode, the negative charged particles can be accelerated up to a high velocity, so that the multiplication factor can be improved by the factor of several powers of ten as compared to the case where the ion beam is directly incident upon the secondary electron multiplier.

However, a change in the energy of the ion beam, that is, a change in the velocity of the ion beam results in a corresponding shift of the point of bombardment on the surface of the conversion electrode which is bombarded by the ion beam to emit the charged particles. More precisely, when the velocity of the ion beam becomes higher, the point of ion beam bombardment on the surface of the conversion electrode shifts away from an ion beam entrance slit, while when the velocity of the ion beam becomes lower, the point of ion beam bombardment on the surface of the conversion electrode shifts toward the ion beam entrance slit. Thus, a change in the velocity of the ion beam results in a corresponding shift of the point of ion beam bombardment on the surface of the conversion electrode, and the charged particles emitted from the bombarded surface of the conversion electrode may not be accurately directed toward the secondary electron multiplier.

In order to obviate such a defect, a method has been commonly employed hitherto in which the voltage applied to the conversion electrode is changed when the velocity of the ion beam changes, so that the ion beam can always accurately bombard the same point on the surface of the conversion electrode. The voltage applied to the conversion electrode is generally approximately proportional to the energy of the ion beam. Therefore, the voltage applied to the conversion electrode must be lowered when the energy of the ion beam becomes lower. However, when the voltage applied to the conversion electrode is lowered, the quantity of the charged particles emitted from the conversion electrode decreases, and the velocity of the emitted charged particles shows also a decrease. The resultant decrease in the multiplication factor of the secondary electron multiplier leads to difficulty of accurate detection of the ionic current.

SUMMARY OF THE INVENTION

It is an object of the present invention to provide a post-acceleration detector for a mass spectro-meter, in which charged particles emitted from the surface of a conversion electrode can be accurately directed toward a secondary electron multiplier even when a change occurs in the energy of an ion beam bombarding the surface of the conversion electrode, so that the ionic current can be accurately detected without lowering the multiplication factor of the secondary electron multiplier.

In accordance with one aspect of the present invention which attains the above object, there is provided a post-acceleration detector for a mass spectro-meter, comprising a conversion electrode bombarded by an ion beam thereby emitting charged particles having a polarity opposite to that of the ion beam, a charged particle detector amplifying and detecting the charged particles, and drive means for moving the conversion electrode relative to the charged particle detector according to the energy of the ion beam.

In accordance with another aspect of the present invention which also attains the above object, there is provided a post-acceleration detector for a mass spectrometer of double focusing type, comprising a conversion electrode bombarded by an ion beam controlled by both an electric field and a magnetic field thereby emitting charged particles having a polarity opposite to that of the ion beam, a charged particle detector amplifying and detecting the charged particles, and drive means for moving the conversion electrode relative to the charged particle detector according to the electric field.

DESCRIPTION OF THE PREFERRED EMBODIMENTS

Figure 1:
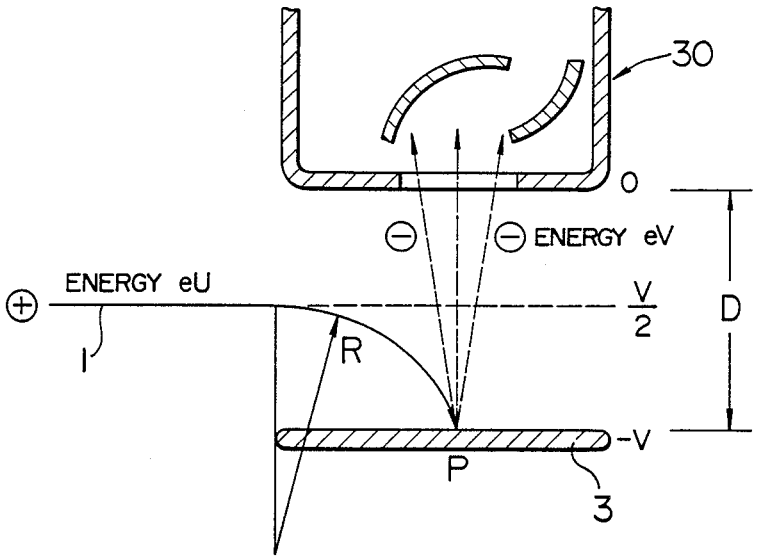
FIG. 1 is a diagrammatic view for illustrating the principle of the present invention.

First, the principle of the post-acceleration detector according to the present invention will be described with reference to FIG. 1. The energy of an incident ion beam 1 consisting of charged particles having a charge e and accelerated by an acceleration voltage U can be expressed as eU. When a voltage V is applied to a conversion electrode 3, and the conversion electrode 3 is spaced from a charged particle detector 30 in FIG. 1 by a distance D, the radius R of the orbit of the ion beam 1 directed toward and into an electric field of the conversion electrode 3 is calculated according to the following equations:

The energy of ions is given by $$e\left(U+\frac{V}{2}\right)=\frac{1}{2}mv^2 \quad (1)$$

where m and v are the mass and velocity of incident ions respectively.

The balance between the electric field strength and the centrifugal force is expressed as $$\frac{mv^2}{R}=e\cdot\frac{V}{D} \quad (2)$$

From the equations (1) and (2), the radius R of the orbit is given by $$R=\left(1+\frac{2U}{V}\right)D \quad (3)$$

Although it seems that the point P of bombardment of the ion beam 1 on the surface of the conversion electrode 3 lies on a parabola rather than the circular orbit having the radius R, it can be assumed by approximation that the point P of ion beam bombardment lies on the circular orbit having the radius R.

Charged particles secondary electrons or secondary negative ions) are emitted from the surface of the conversion electrode 3 bombarded by the ion beam 1 at the point P and are then accelerated by the acceleration energy eV to fly toward a charged particle detector 30. The multiplication factor of this charged particle detector 30 is proportional to the electron acceleration energy eV, but has not any direct concern with the distance D.

Therefore, the conversion electrode 3 is preferably moved away from the charged particle detector 30 in the arrangement shown in FIG. 1 when the energy of the ion beam 1 becomes lower, so that the ionic current can be accurately detected without lowering the multiplication factor of the charged particle detector 30.

Preferred embodiments of the present invention will now be described with reference to FIGS. 2 to 8.

Figure 2:
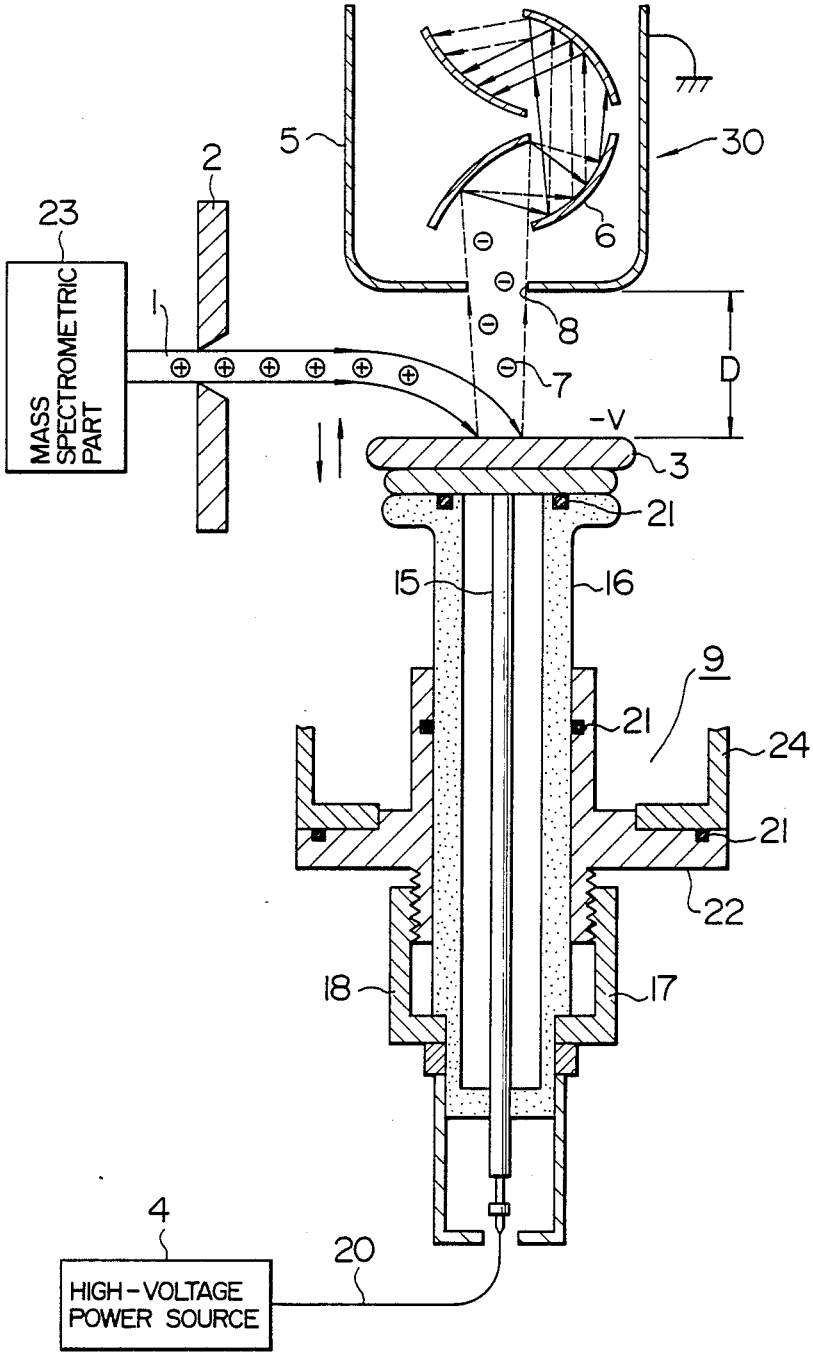
FIG. 2 is a schematic sectional view showing the general structure of an embodiment of the post-acceleration detector according to the present invention.

FIG. 2 shows the general structure of an embodiment of the post-acceleration detector according to the present invention. Referring to FIG. 2, a conversion electrode 3 is disposed on one side of a slitted plate 2 having a slit through which a positive ion beam 1 from a mass spectrometric part 23 passes. This conversion electrode 3 is fixed to a drive control mechanism 9 provided as a drive means for moving the conversion electrode 3. Thus, by actuating the drive control mechanism 9, the conversion electrode 3 can be moved in the direction shown by the arrows. The conversion electrode 3 is electrically connected to a high-voltage power source 4 which applies a high negative voltage. This high-voltage power source 4 can generate a variable output voltage. A shielding electrode 5 is disposed above the conversion electrode 3, and an opening 8 is formed in the bottom wall of the shielding electrode 5. A secondary electron multiplier 6 is disposed inside the shielding electrode 5 so as to amplify charged particles 7 emitted from the conversion electrode 3. The combination of the shielding electrode 5 and the secondary electron multiplier 6 constitutes a charged particle detector 30.

The detailed structure of the drive control mechanism 9 will now be described. Referring to FIG. 2, an electrode rod 15 is connected at one end to the conversion electrode 3 having an L-like sectional shape and at the other end to one end of a high-voltage cable 20 connected at the other end to the high-voltage power source 4. A hollow cylindrical, electrical insulating member 16 is disposed outside the electrode rod 15 to surround the electrode rod 15, and a freely rotatable drive screw 17 is mounted on the outer surface of the cylindrical insulating member 16. This drive screw 17 makes meshing engagement with a screw threaded portion 18 formed on an axial extension of a flange 22 mounted to a casing 24, so that the conversion electrode 3 can be moved in the arrowed direction by rotation of the drive screw 17. O-rings 21 maintain a vacuum in the internal space of the casing 24.

The operation of the embodiment of the post-acceleration detector will now be described with reference to FIG. 2.

When the positive ion beam 1 is directed through the slit of the slitted plate 2 while applying the negative high voltage to the conversion electrode 3 from the high-voltage power source 4, the ion beam 1 is deflected toward the conversion electrode 3 by an electric field established between the conversion electrode 3 and the shielding electrode 5 and bombards the surface of the conversion electrode 3. As a result of this bombardment, negative charged particles (the majority of which are secondary electrons) 7 are emitted from the bombarded surface of the conversion electrode 3. The emitted charged particles 7 are accelerated by the electric field to fly at a high speed toward the shielding electrode 5 and pass through the opening 8 of the shielding electrode 5 to reach the secondary electron multiplier 6. In the secondary electron multiplier 6, the charged particles 7 are amplified and detected as an ionic current.

The radius R of the orbit of the ion beam 1 in the electric field is small when the energy U of the ion beam 1 is low. In such a case, the relative distance D between the conversion electrode 3 and the shielding electrode 5 is increased. That is, the drive control mechanism 9 is actuated to move the conversion electrode 3 downward in FIG. 2. When the conversion electrode 3 is moved downward, the quantity of the charged particles 7 lost at the shielding electrode 5 will slightly increase. However, because the voltage V applied to the conversion electrode 3 need not be lowered unlike the prior art case, the acceleration voltage for accelerating the low-energy ion beam 1 remains unchanged, so that an undesirable extreme reduction of the multiplication factor of the charged particle detector 30 can be prevented.

Figure 3:
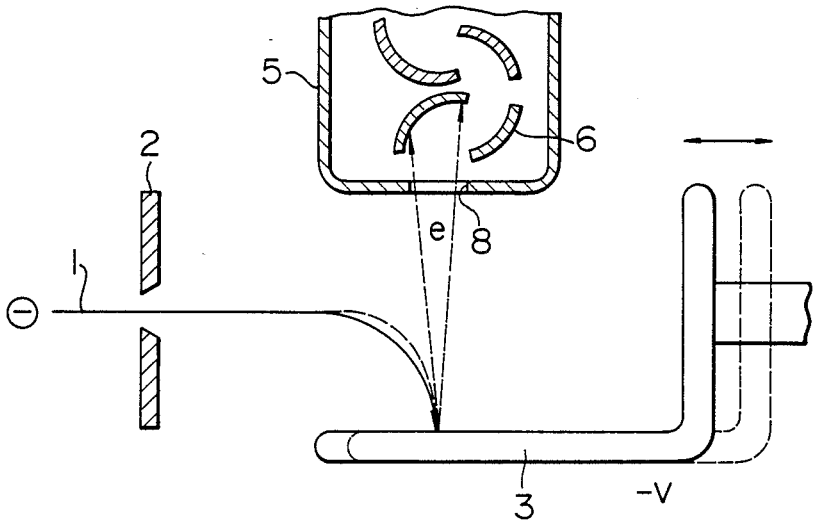
FIG. 3 is a diagrammatic view showing the arrangement employed in another embodiment of the present invention.

FIG. 3 shows another embodiment of the present invention. In the embodiment shown in FIG. 2, the conversion electrode 3 is moved in the direction parallel with respect to the central axis of the secondary electron multiplier 6. In the case of the second embodiment which is a modification of the first embodiment, the conversion electrode 3 is moved in a direction orthogonal (rightward and leftward in FIG. 3) with respect to the central axis of the secondary electron multiplier 6.

The arrangement of the other parts is similar to that of the first embodiment.

When the energy U of the ion beam 1 is low, the conversion electrode 3 is moved rightward in FIG. 3 without changing the value of the voltage V applied to the conversion electrode 3. Thus, the starting position of deflection of the ion beam 1 toward the conversion electrode 3 by the function of the electric field established by the voltage V applied to the conversion electrode 3 is now shifted rightward in FIG. 3. That is, the point of bombardment of the ion beam 1 on the surface of the conversion electrode 3 is shifted rightward relative to the opening 8 of the shielding electrode 5. Therefore, the effect similar to that provided by the first embodiment shown in FIG. 2 can also be exhibited.

Figure 4:
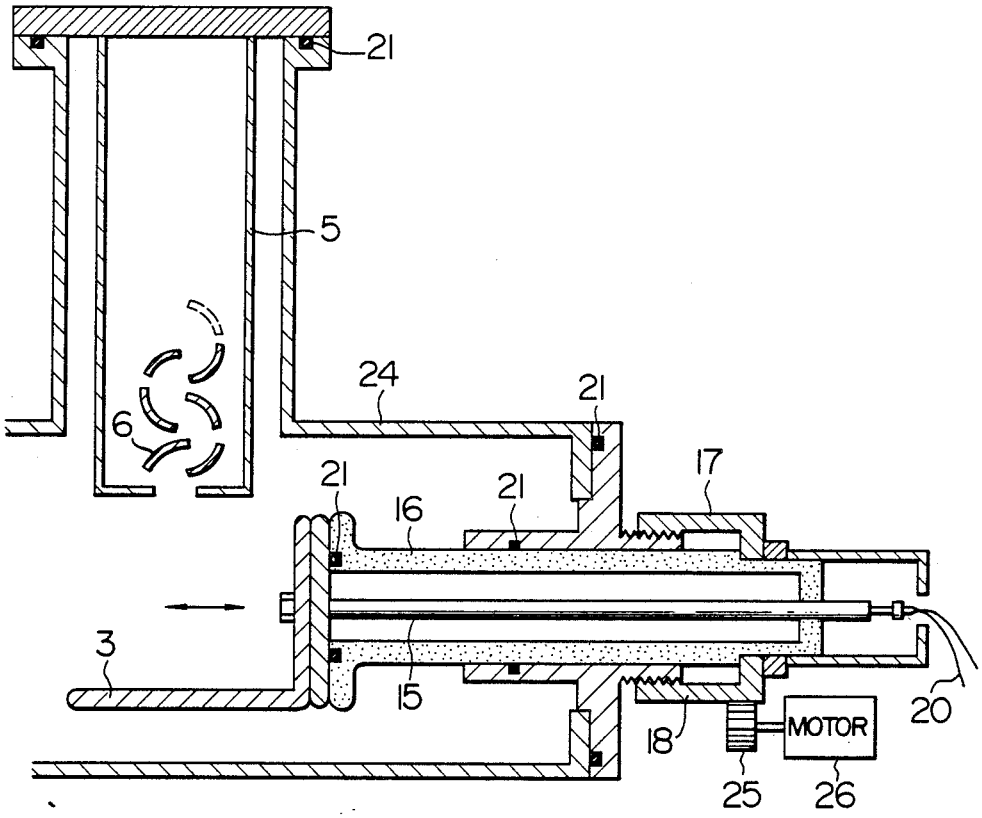
FIG. 4 is a schematic sectional view showing in detail the structure of the driver in the embodiment shown in FIG. 3.

FIG. 4 shows in detail the structure of the drive control mechanism employed in the second embodiment shown in FIG. 3, and the elements having the same functions as those of the elements shown in FIG. 2 are designated by the same reference numerals. Although the drive screw 17 shown in FIG. 4 may be manually rotated, it may be rotated by a motor 26 through a reduction gearing 25.

Figure 5:
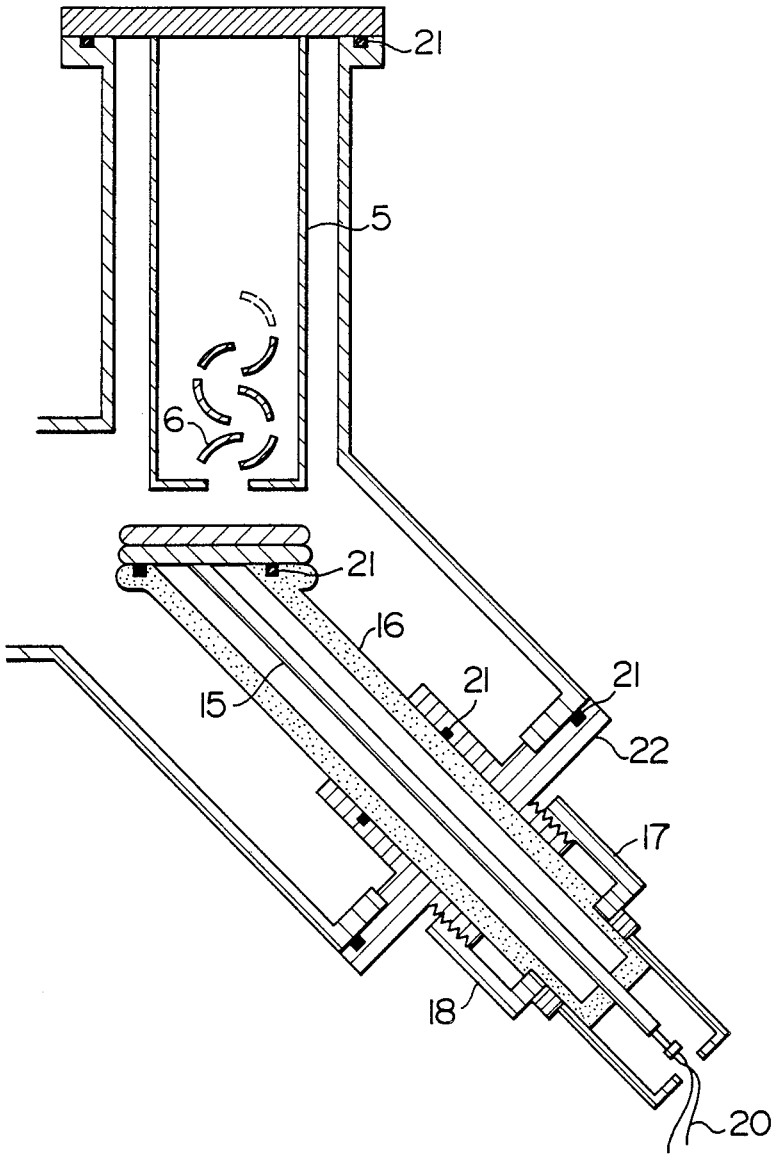
FIG. 5 is a schematic sectional view showing the structure of still another embodiment of the present invention.

FIG. 5 shows a modification of the drive control mechanism shown in FIG. 4. In FIG. 5, the conversion electrode 3 is moved in an oblique direction making an angle with respect to the central axis of the secondary electron multiplier 6. This modification is also as effective as the structure shown in FIG. 4.

Figure 6:
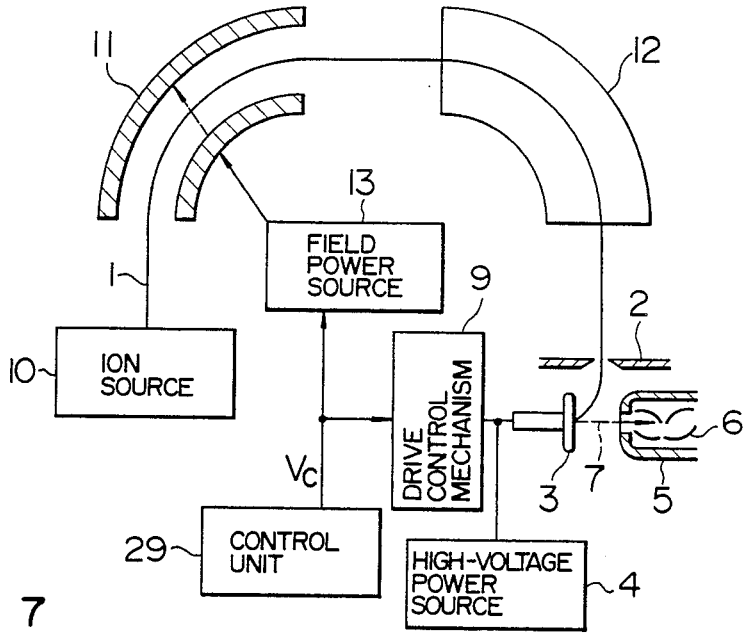
FIG. 6 is a diagrammatic view showing the general structure of yet another embodiment of the present invention.

FIG. 6 shows still another embodiment of the post-acceleration detector of the present invention which is applied to a mass spectrometer of double focusing type having means for producing both an electric field and a magnetic field. In FIG. 6, like reference numerals are used to designate like elements appearing in FIG. 2.

Referring to FIG. 6, an ion beam 1 emitted from an ion source 10 passes through a sectoral electric field 11 and a sectoral magnetic field 12 and then passes through a slit of a slitted plate 2 to be directed toward a conversion electrode 3.

The sectoral electric field 11 is controlled by an electric field power source 13 so that it has a required field strength. This sectoral electric field 11 acts to separate the ion beam 1 according to the magnitude of the energy of the ion beam 1, so that the value of the energy of the ion beam 1 passed through the slit of the slitted plate 2 is dependent upon the electric field strength determined by the electric field power source 13.

Figure 7:
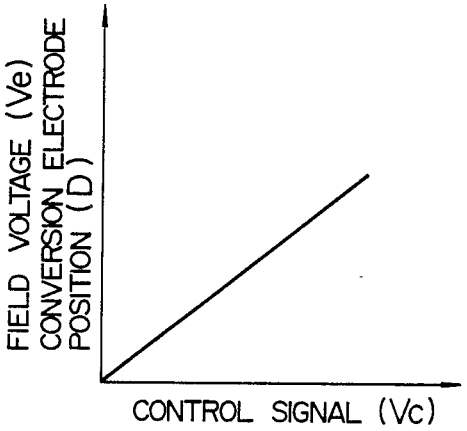
FIG. 7 is a graph illustrating the operation of the embodiment of the present invention shown in FIG. 6.

A control unit 29 generates a control signal Vc so as to control the electric field power source 13 thereby controlling the strength of the electric field 11. The control signal Vc from the control unit 29 is also applied to a drive control mechanism 9 to cause controlled movement of the conversion electrode 3. Thus, charged particles emitted from the surface of the conversion electrode 3 as a result of bombardment of the ion beam 1 having a predetermined quantity of energy controlled by the electric field 11 can be accurately directed toward a charged particle detector 6. The moving distance of the conversion electrode 3 is substantially linearly proportional to an increment or a decrement of the voltage supplied from the electric field power source 13 establishing the electric field 11. Therefore, a linearly proportional relation as shown in FIG. 7 can be provided between the control signal Vc generated from the control unit 29 and the voltage Ve generated from the electric field power source 13 as well as the position D of the conversion electrode 3 moved by the drive control mechanism 9.

Thus, according to the arrangement shown in FIG. 6, the control unit 29 adequately controls the electric field power source 13 thereby controlling the field voltage Ve according to the energy of the ion beam 1, and the drive control mechanism 9 controls the position of the conversion electrode 3 according to the controlled field voltage Ve. Therefore, even when a change may occur in the energy of the incident ion beam 1, the conversion electrode 3 is moved by the drive control mechanism 9 by a distance which meets such a change in the energy of the incident ion beam 1 until it is located at the appropriate position, and the voltage V applied to the conversion electrode 3 need not be changed. Consequently, ions having different energies can be detected without lowering the multiplication factor of the post-acceleration detector.

Figure 8:
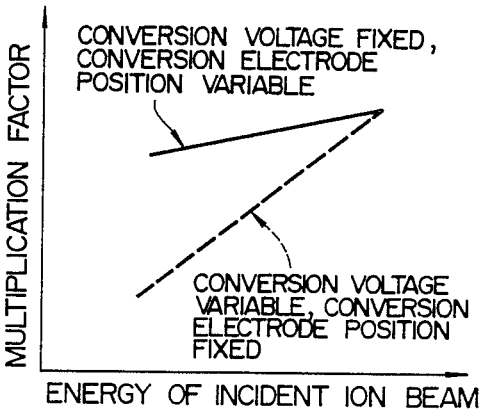
FIG. 8 is a graph showing the relation between the energy of the incident ion beam and the multiplication factor of the post-acceleration detector in the embodiment shown in FIG. 6.

FIG. 8 shows the relation between the energy of the incident ion beam 1 (the acceleration voltage) and the multiplication factor of the post-acceleration detector. In FIG. 8, the dotted line represents the above relation when the voltage applied to the conversion electrode 3 (referred to hereinafter as a conversion voltage) is variable so as to deal with a change in the energy of the ion beam 1, while the position of the conversion electrode 3 is fixed. It will be seen that the multiplication factor shows a sharp decrease because the conversion voltage is decreased with the decrease in the energy of the ion beam 1. On the other hand, the solid line represents the above relation when the position of the conversion electrode is made variable so as to deal with a change in the energy of the ion beam, while the conversion voltage is maintained constant. It will be seen that the multiplication factor shows a very slight decrease even when the energy of the ion beam becomes lower.

We claim:

1. A post-acceleration detector for a mass spectrometer, comprising:

a conversion electrode which, when an ion beam from a mass spectrometric part is directed to bombard its surface, emits charged particles having a polarity opposite to that of charged particles forming said ion beam;

means for applying a voltage to said conversion electrode so that said ion beam from said mass spectrometric part can be directed to bombard the surface of said conversion electrode and so that an electric field for accelerating said charged particles emitted from the bombarded surface of said conversion electrode can be established;

a charged particle detector for detecting said charged particles emitted from said conversion electrode and accelerated by said electric field; and drive means for moving said conversion electrode relative to said charged particle detector.

2. A post-acceleration detector for a mass spectrometer according to claim 1, wherein said drive means moves said conversion electrode in a direction parallel with respect to the central axis of said charged particle detector.

3. A post-acceleration detector for a mass spectrometer according to claim 1, wherein said drive means moves said conversion electrode in a direction orthogonal with respect to the central axis of said charged particle detector.

4. A post-acceleration detector for a mass spectrometer according to claim 1, wherein said drive means moves said conversion electrode in a direction oblique with respect to the central axis of said charged particle detector.

5. A post-acceleration detector for a mass spectrometer of double focusing type comprising:

a conversion electrode which, when an ion beam from a mass spectrometric part is directed to bombard its surface, emits charged particles having a polarity opposite to that of charged particles forming said ion beam;

means for applying a voltage to said conversion electrode so that said ion beam from said mass spectrometric part can be directed to bombard the surface of said conversion electrode and so that an electric field for accelerating said charged particles emitted from the bombarded surface of said conversion electrode can be established;

a charged particle detector for detecting said charged particles emitted from said conversion electrode and accelerated by said electric field; and drive means for moving said conversion electrode relative to said charged particle detector according to the strength of said electric field established adjacent to said mass spectrometric part.

* * * * *